US007549303B2

(12) United States Patent
Callaway et al.

(10) Patent No.: US 7,549,303 B2
(45) Date of Patent: Jun. 23, 2009

(54) TEXTILE-REINFORCED COMPOSITES WITH HIGH TEAR STRENGTH

(75) Inventors: Brian Callaway, Moore, SC (US); Randolph S. Kohlman, Boiling Springs, SC (US); David W. Martin, Anderson, SC (US)

(73) Assignee: Milliken & Company, Spartanburg, SC (US)

( * ) Notice: Subject to any disclaimer, the term of this patent is extended or adjusted under 35 U.S.C. 154(b) by 10 days.

(21) Appl. No.: 11/986,499

(22) Filed: Nov. 21, 2007

(65) Prior Publication Data

US 2009/0126411 A1 May 21, 2009

(51) Int. Cl.
*D04B 23/08* (2006.01)

(52) U.S. Cl. ..... 66/192; 66/195

(58) Field of Classification Search ..... 66/192, 66/193, 195, 190, 191, 194, 196, 178 R, 179, 66/180, 181, 182, 183, 184, 185
See application file for complete search history.

(56) References Cited

U.S. PATENT DOCUMENTS

| | | | | | |
|---|---|---|---|---|---|
| 3,842,628 | A | * | 10/1974 | Bennett et al. | 66/193 |
| 4,100,770 | A | * | 7/1978 | Titone | 66/193 |
| 4,333,321 | A | * | 6/1982 | Schneider et al. | 66/192 |
| 4,392,363 | A | * | 7/1983 | Matsuda | 66/193 |
| 4,442,685 | A | * | 4/1984 | Matsuda | 66/193 |
| 4,450,694 | A | * | 5/1984 | Matsuda et al. | 66/193 |
| 4,468,422 | A | | 8/1984 | Siener, Jr. et al. | 428/57 |
| 5,373,712 | A | * | 12/1994 | Yamamoto et al. | 66/195 |
| 5,393,596 | A | * | 2/1995 | Tornero et al. | 442/225 |
| 5,399,419 | A | | 3/1995 | Porter et al. | 428/236 |
| 5,637,379 | A | | 6/1997 | Lagemann et al. | 428/193 |
| 5,851,638 | A | | 12/1998 | Lagemann et al. | 428/193 |
| 6,004,645 | A | | 12/1999 | Hubbard | 428/57 |
| 6,041,624 | A | * | 3/2000 | Pederzini | 66/193 |
| 6,082,148 | A | * | 7/2000 | Wakai et al. | 66/192 |
| 6,238,502 | B1 | | 5/2001 | Hubbard | 156/71 |
| 6,355,329 | B1 | | 3/2002 | Rose et al. | 428/110 |
| 6,544,909 | B1 | | 4/2003 | Venkataswamy et al. | 442/38 |
| 7,181,933 | B2 | | 2/2007 | Callaway et al. | 66/193 |
| 7,207,195 | B2 | * | 4/2007 | Okawa | 66/193 |

* cited by examiner

*Primary Examiner*—Danny Worrell
(74) *Attorney, Agent, or Firm*—Cheryl J. Brickey

(57) ABSTRACT

The present disclosure relates to a reinforcing textile material that comprises a weft-inserted warp knit fabric, in which the warp yarns are configured in a pattern having a majority of successive flat stitches that are used in conjunction with a minority of subsequent successive round stitches. The warp yarn configuration may be represented by the expression x+y, where x is the number of successive needle positions in which a warp yarn is positioned in a flat stitch arrangement and y is the number of subsequent successive needle positions in which the same warp yarn is positioned in a round stitch arrangement. The present weft-inserted warp knit fabrics possess improved dimensional stability, high tensile strength, high tear strength, and a relatively smooth surface, making them well-suited for use as reinforcements in roofing membranes, signs, banners, tents, and the like.

21 Claims, 9 Drawing Sheets

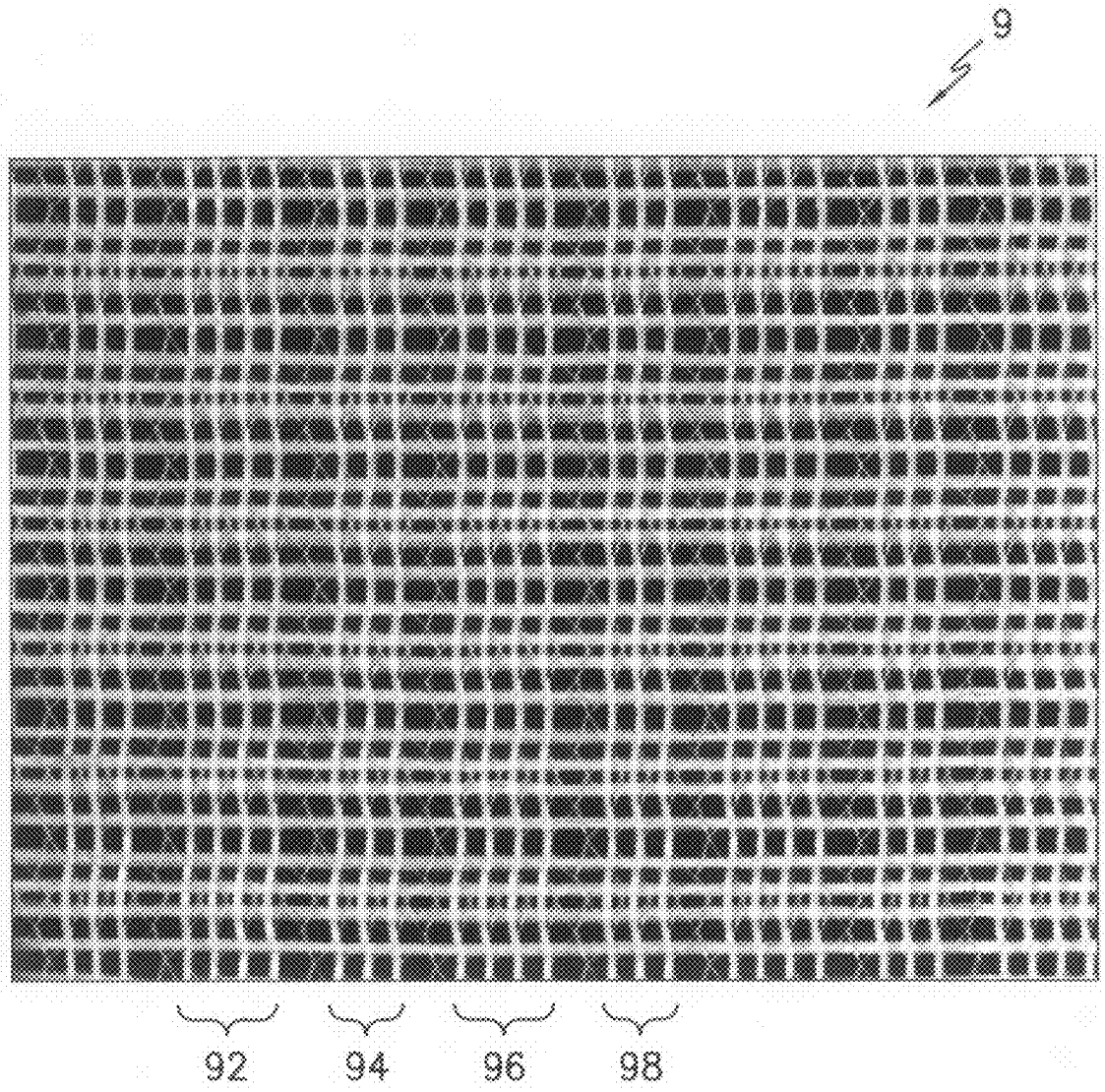
FIG. —9C—

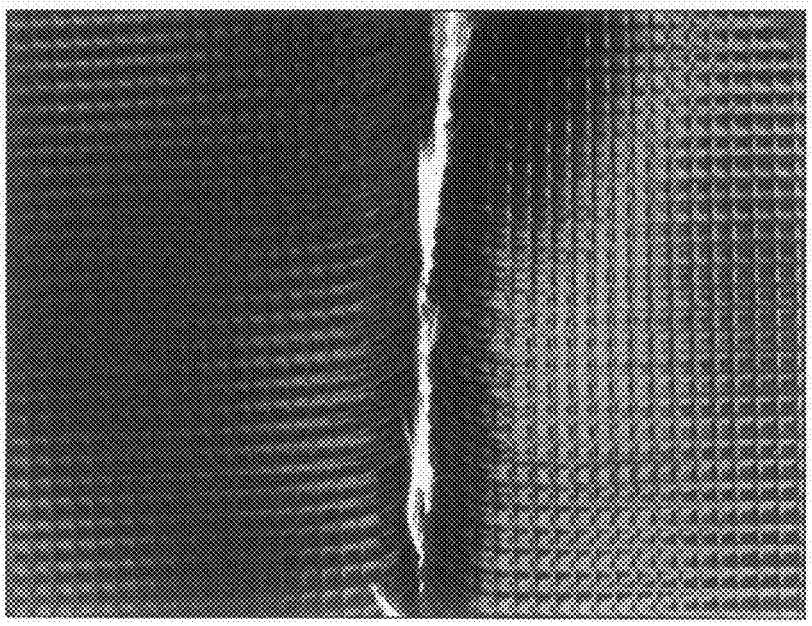
FIG. –10–
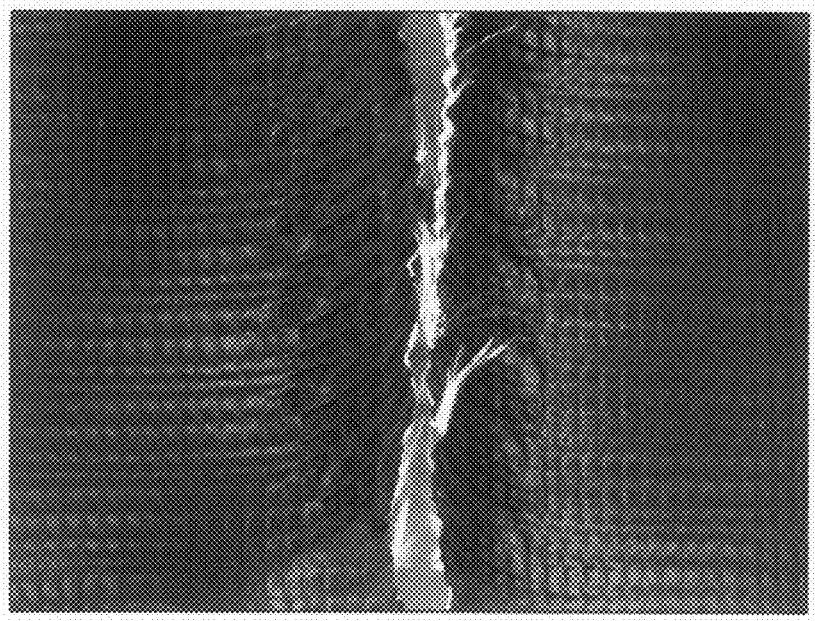
FIG. –11–

TEXTILE-REINFORCED COMPOSITES WITH HIGH TEAR STRENGTH

TECHNICAL FIELD

The present disclosure relates to an improved substrate for reinforcing composite materials, which substrate utilizes one or more unique warp configurations within a weft-inserted warp knit (WIWK) fabric. The warp configurations, as will be described herein, produce a substrate that exhibits greater dimensional stability than a flat stitch configuration (for example, when coated to form a composite), lower gauge than a round stitch configuration, and greater tear strength, especially in the weft direction. Specifically, the textile reinforcement layer is a weft-insert warp knit fabric, in which the warp yarns are configured in a repeating pattern of consecutive flat stitches followed by at least one round stitch. In one embodiment, the warp yarn pattern may be altered by removing individual warp yarns, such that groups of warp yarns are formed with a gap between adjacent groups.

The present disclosure is also directed to composite materials that include such a textile reinforcement layer. Such composite materials are typically formed by encapsulating a textile reinforcement layer with a thermoplastic or elastomeric coating. The warp configurations facilitate the encapsulation, or coating, process by providing greater interstitial voids in which the coating material may be embedded. Such composite materials may be useful for roofing membranes, tents, tarpaulins, signs, banners, billboards, and the like.

SUMMARY

The present disclosure relates to a reinforcing textile material that comprises a weft-inserted warp knit fabric, in which the warp yarns are configured in a pattern having a majority of successive flat stitches that are used in conjunction with a minority of subsequent successive round stitches. The warp yarn configuration may be represented by the expression x+y, where x is the number of successive needle positions in which a warp yarn is positioned in a flat stitch arrangement and y is the number of subsequent successive needle positions in which the same warp yarn is positioned in a round stitch arrangement.

Often, weft-insert warp knits are produced are equipment having pattern wheels that control the stitch formation. These pattern wheels typically have 48 slots. Preferably, when this kind of equipment is used, the x and y values are based on factors of 48 (for example, a warp configuration may be based on 12 positions or 16 positions). Thus, a multiple of x+y equals the number of slots in the pattern wheel. A particularly preferred embodiment is that case for which y=1. Accordingly, when the warp configuration is produced using 12 positions and when y=1, the corresponding x values are one of 3, 5, and 11. Similarly, when the warp configuration is produced using 16 positions and when y=1, the corresponding x values are one of 3, 7, and 15.

Alternately, one skilled in the art may substitute a pattern chain for the pattern wheel described above. The chain may possess the same number of links as the pattern wheel has slots. In a second embodiment, the chain may possess more links than that of the pattern wheel by using one or more idler rolls to provide support for a longer length (that is, more links), thereby extending the warp configuration repeats that may be achieved. A pattern chain may be used to create a wide range of stitch configurations, including, by way of example only and not as limitations, x+y warp configurations in which the x value in the stitch is the range of 3 to 15 and the y value is in the range of 1 to 4.

Newer knitting machines replace pattern wheels or chains with electronic control systems. In these systems, there are far greater possibilities for the warp configurations that may be achieved, because the configurations are not limited by a finite number of spaces on a pattern wheel or chain. Of course, the x+y warp configurations described herein can easily be reproduced using these types of systems as well.

By using a warp configuration where the warp yarns are positioned in a flat stitch configuration for successive needle positions followed by a smaller number of subsequent successive needle positions in which the warp yarns are in a round stitch configuration, and preferably where the warp yarns having an x+y configuration, a weft-inserted warp knit fabric is created that possesses improved dimensional stability, high tensile strength, high tear strength, and a relatively smooth surface. Further, the gauge (i.e., the thickness) of the reinforcing textile is substantially the same as previous weft-inserted warp knit fabric substrates created using only a flat stitch configuration for the warp yarns.

BRIEF DESCRIPTION OF THE DRAWINGS

FIG. 9C is a photograph of the fabric of FIG. 9B;

FIG. 10 is a photograph of a composite reinforced with the fabric of FIG. 4C, after such composite has been subjected to tear strength testing in the weft direction;

FIG. 11 is a photograph of a composite reinforced with the fabric of FIG. 5C, after such composite has been subjected to tear strength testing in the weft direction.

DETAILED DESCRIPTION

The weft yarns, as the fabric is being knitted, are supplied outwardly from the needles and sequentially carried over a driven roll, an idler roll, and a second driven roll to a supply roll. In conventional manner, the weft yarns are laid in on the back side of the needles.

The warp yarns are fed through a guide bar and are positioned over the weft yarns and are held at least loosely in position by stitch yarns. In the case of a flat stitch configuration, the guide bar carrying the warp yarns remains in a stationary position. In the case of a round stitch, the guide bar moves back and forth in a horizontal direction from one needle position to a neighboring needle position. In the present warp yarn configuration, the guide bar remains stationary for "x" number of courses and then moves over one needle position for "y" number of courses, thereby creating the x+y configuration.

As the fabric is produced, the needle moves upwardly through the loop while the fingers of the fabric hold-down bar maintain a downward pressure on the fabric. Then the guide bars are swung through and around the needles and back again to form another loop in the hook or eye of the needle. The needles are retracted to allow the loop to be knocked over or cast off as the needle drops down, and the closing wire engages the hook or eye to keep the newly formed loop in position, while the previous loop is cast off, until the action is started over again with the next stitch. It should be noted that during this whole operation the sinker bar remains fixed, and the hold-down bar remains engaged on the previously formed loops to prevent them from breaking out after being cast off the needle.

In making the present weft-insert warp knit fabrics, where gauge is a consideration, the loops are open, rather than closed. However, when stability is of greater concern, the loops may alternatively be closed. The knit fabric is pulled away from the needles by the drive roll.

Figure 1:
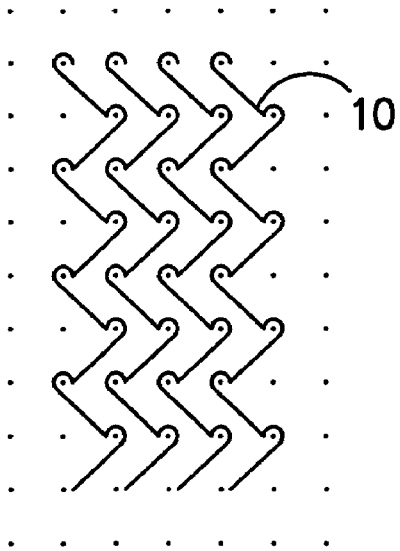
FIG. 1 is a needle bed point diagram illustrating the component stitch yarns used in the various weft-insert warp knit fabric constructions described herein.

The pattern of the stitch yarns 10 is shown in a needle bed point diagram in FIG. 1. This open-loop stitch pattern is common to all of the fabric constructions described herein. The stitch yarns 10 may be made from any of a number of materials, including polyester, nylon, polyolefins, aramids, carbon, fiberglass, cotton, and the like, and combinations thereof. The stitch yarns 10 are preferably comprised of continuous filament polyester. The stitch yarns 10 have a size in the range of 30 denier to 300 denier and, more preferably, a size in the range of 40 denier to 70 denier. The stitch yarns 10 may also be referred to as "tie yarns" or "knitting yarns."

Figure 2:
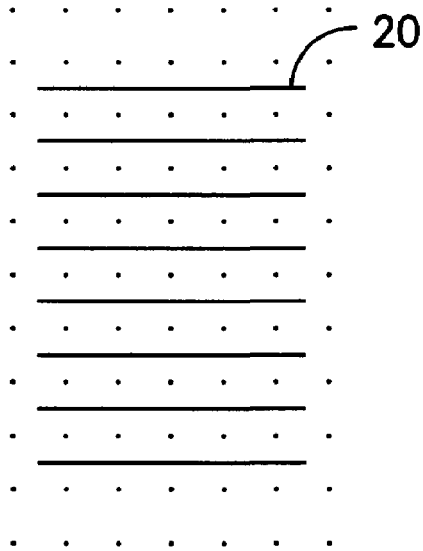
FIG. 2 is a needle bed point diagram illustrating the component weft yarns used in the various weft-insert warp knit fabric constructions described herein.

The pattern of the weft-inserted yarns 20 is shown in a needle bed point diagram in FIG. 2. This straight-through pattern is common to all of the fabric constructions described herein. Various configurations of the warp yarns are shown in FIGS. 3A, 4A, 5A, 6A, 7A, 8A, and 9A. The weft-inserted yarns 20 and warp yarns (identified in the Figures as 30, 40, 50, 60, 70, 80, and 90) are preferably made of a high tenacity material, including, without limitation, polyester, nylon, polyolefins, aramids, glass, basalt, carbon, and combinations thereof. The maximum size of the warp and weft yarns is determined by the gauge of the machine, as in known to one of skill in the art. Preferably, the warp yarns 30-90 and weft yarns 20 comprise a flat filament polyester yarn having a size in the range of 150 denier to 3000 denier and, more preferably, a size in the range of 500 denier to 1300 denier. The yarns for both the warp and weft could be either textured or untextured. Plied yarns, tape yarns, and monofilament yarns may also be used.

To create the warp configuration described herein, the warp yarn is fed into the knitting machine in a substantially straight orientation, akin to a flat stitch, for successive needle positions (e.g., three) before performing a round stitch for some number of subsequent successive needle positions (e.g., one). In one embodiment, the warp yarn guide bar is controlled by a pattern wheel, which moves the warp yarns over one needle position to create the round stitch. As has been discussed, pattern chains or computer-controlled systems may also be used. After the round stitch is completed, the yarns are moved back to their original position. The pattern of flat stitches and round stitches is then repeated.

The present warp configurations may be used across the entire width of the fabric or in only one or more localized areas, assuming the knitting machine is equipped with enough bars to support multiple warp yarn configurations.

In the various warp yarn configurations provided herein, the warp yarns are positioned in a flat stitch configuration for multiple successive needle positions followed by a (preferably smaller) number of subsequent successive needle positions in which the warp yarns are in a round stitch configuration, such that the warp yarn configuration follows the expression x+y, where x is the number of successive needle positions where a flat stitch is created and y is the number of subsequent successive needle positions where a round stitch is created.

Figure 5A:
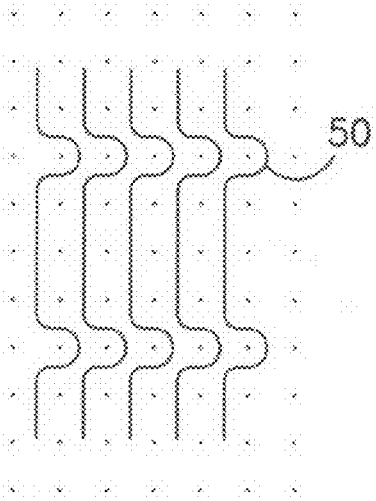
FIG. 5A is a needle bed point diagram of a 3+1 warp configuration, in which the warp yarns create a flat stitch pattern for three consecutive needle positions and a round stitch pattern for one needle position.

As discussed above, the x and y values are preferably based on the number of slots in standard pattern wheels, when a knitting machine having a pattern wheel is used. In particular, a multiple of x+y preferably equals the number of slots in the pattern wheel. For example, in a 48-slot pattern wheel, when x+y=16, each needle movement is carried out over three slots in the pattern wheel. Again using a 48-slot pattern wheel, when x+y=12, each movement is carried out over four slots in the pattern wheel. Thus, when y=1, the preferred x values for a 12-slot pattern are 3, 5, and 11, and the preferred x values for a 16-slot pattern are 3, 7, and 15. The 3+1 pattern is illustrated in FIG. 5A; the 5+1 pattern, in FIG. 6A; the 7+1 pattern, in FIG. 7A; and the 11+1 pattern, in FIG. 8A.

Employing a WIWK machine having a pattern wheel limits the available combinations of warp yarn configurations that may be used, because the x+y expression must be equal to a factor of the number of slots in the pattern wheel. However, using a pattern chain or electronic control removes these limitations. With these kinds of systems, there are more choices for the x and y values possible for the warp yarn configuration. These x values include integers in the range of 3 to 15, and the y values are in the range of 1 to 4. Accordingly, by way of example and not limitation, a 14+1, 14+2, 14+3, or 14+4 stitch configuration could be used, especially when an exceptionally smooth fabric (i.e., a fabric with uniform low gauge) is desired.

One contemplated alternative to the x+y warp yarn configuration discussed herein is a variation in which two or more warp yarn configurations are used for the same individual warp yarn. A fabric having multiple warp yarn configurations may be created in which, for example, a first warp yarn is configured initially with an x+y pattern that is followed by a second configuration having an a+b pattern, where x and a represent the number of successive flat stitches and y and b represent the number of subsequent successive round stitches, and x is not necessarily equal to a and y is not necessarily equal to b.

A third configuration for an individual warp yarn may also be used (e.g., an m+n configuration, where m and n are different integers and are not necessarily equal to their predecessors). The patterns could be chosen from any combination of warp yarn configurations having numbers of flat stitches and round stitches in the preferred ranges described herein. As contemplated herein, the values for the number of successive flat stitches (represented by x, a, and m) are integers in the range of 3 to 15, and the values for the number of subsequent successive round stitches (represented by y, b, and n) are integers in the range of 1 to 4.

Moreover, different warp yarn configurations may be used within the same fabric. That is, rather than an individual warp yarn having multiple yarn configurations over its length, the warp yarn configuration of a first warp yarn may vary from that of other warp yarns in the same warp yarn sheet. Such an approach may be advantage in developing areas within the fabric with greater dimensional stability or in developing patterns of alternating warp yarn configurations for aesthetic or other reasons.

Figure 3A:
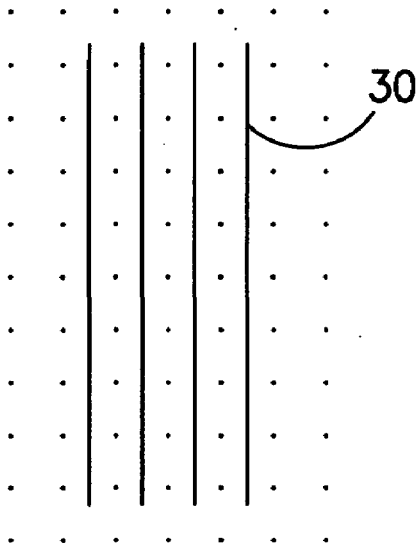
FIG. 3 is a needle bed point diagram illustrating the component warp yarns used in a weft-insert warp knit fabric, in which the warp yarns are positioned in a conventional flat stitch configuration.
FIG. 3B is a needle bed point diagram of a weft-insert warp knit fabric in which the warp yarns are present in the flat configuration shown in FIG. 3.
Figure 3B:
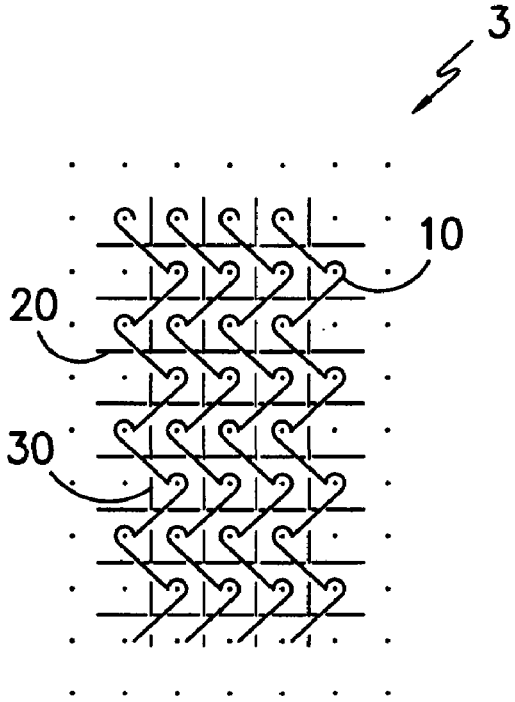

Turning back to the drawings, FIG. 3A is a needle bar point diagram showing a plurality of warp yarns 30 in a flat stitch configuration. Such flat stitch configurations produce a fabric 3 (shown in FIG. 3B) with consistent and low gauge, resulting in a smooth surface ideal for lamination and printing. However, because the warp yarns 30 are not held tightly by other yarns in the fabric construction, the warp yarns 30 tend to "spread out" (that is, the multi-filament yarn bundles tend to separate) and fill the interstices between the warp yarns 30, weft yarns 20, and stitch yarns 10. A positive consequence of this occurrence is that the tear strength of such a fabric 3 is typically fairly high, as the warp yarns 30 may shift together as the fabric 3 is being torn, thus making tearing the fabric 3 more difficult. One downside of such constructions is that lamination may be adversely affected, since the blocked interstices prevent the flow-through of a coating or lamination material, thereby inhibiting the formation of a strong bond. Accordingly, the peel strength of laminated composites having a flat-stitch reinforcement (i.e., fabric 3) is low.

Figure 4A:
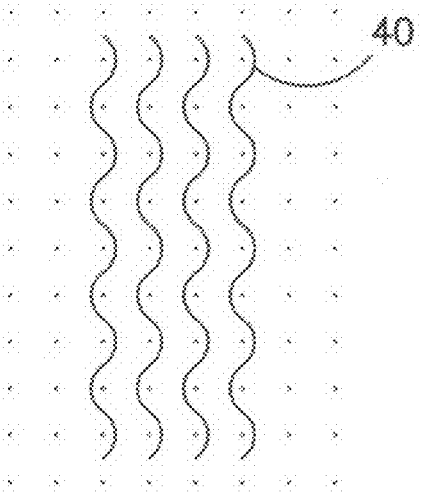
FIG. 4A is a needle bed point diagram illustrating the component warp yarns used in a weft-insert warp knit fabric, in which the warp yarns are positioned in a conventional round stitch configuration.
Figure 4B:
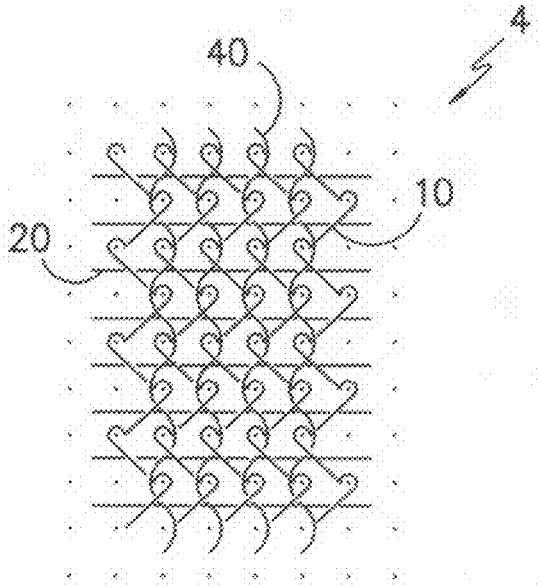
FIG. 4B is a needle bed point diagram of a weft-inserted warp knit fabric in which the warp yarns are present in the round configuration shown in FIG. 4A.

FIG. 4A is a needle bar point diagram showing a plurality of warp yarns 40 in a round stitch configuration. Such round stitch configurations produce a more dimensionally stable fabric 4 (shown in FIG. 4B) with a higher gauge than that of fabric 3 and with a slightly uneven surface topography, both of which are caused by the warp yarns 40 wrapping around the stitch yarns 10. Although the resulting fabric surface is rougher (making it unsuitable for some applications), the production of composites using fabric 4 is facilitated by the proximity of the warp yarns 40 to the stitch yarns 10.

Figure 4C:
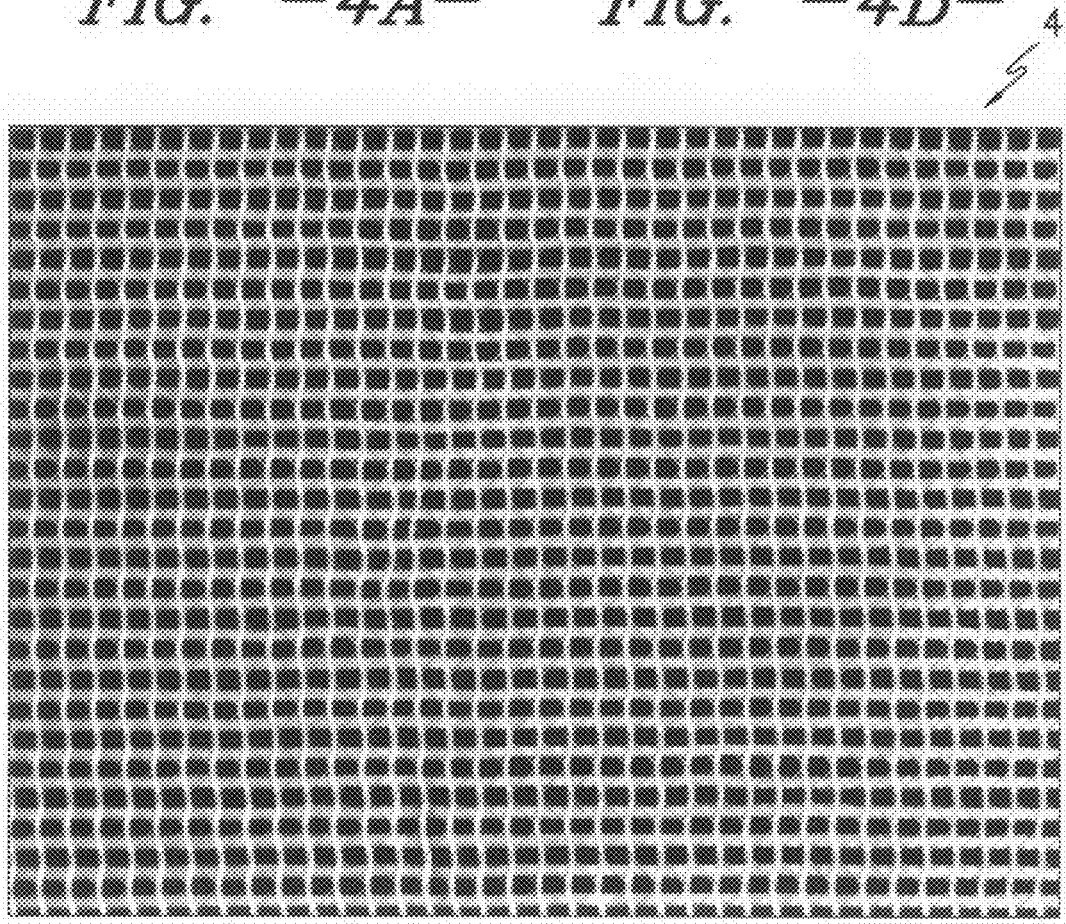
FIG. 4C is a photograph of the fabric of FIG. 4B, showing the uniform spacing between the warp and weft yarns.

Because the warp yarns 40 are configured in a round orientation, the warp yarns 40 tend to be positioned closer to the stitch yarns 10, thereby preventing the warp yarns 40 from spreading out and maintaining larger interstices between the yarns 10, 20, 40. As a result, good adhesion of subsequently applied coatings or adhesives is made possible, and the composites having a round-stitch reinforcement (i.e., fabric 4) tend to have higher peel strength than those produced with fabric 3. FIG. 4C is a photograph of fabric 4, which shows the uniform spacing between the warp yarns and weft yarns, leading to uniformly sized and shaped interstices.

FIG. 5A is a needle bar point diagram showing a plurality of warp yarns 50 in a 3+1 yarn configuration. As shown, each warp yarn 50 produces three flat stitches before producing a single round stitch. This pattern is accomplished by allowing the guide bar to remain in a constant position for three courses and to then be shifted over one needle position to make a round stitch. After the round stitch is formed, the guide bar shifts back to its original position, and the pattern is repeated.

Figure 5B:
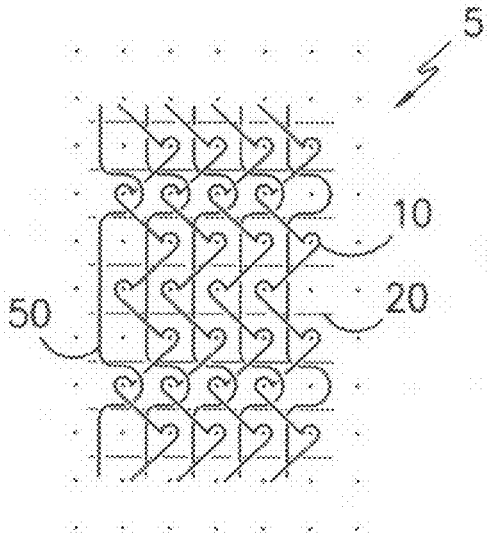
FIG. 5B is a needle bed point diagram of a weft-inserted warp knit fabric in which the warp yarns are present in the 3+1 configuration shown in FIG. 5A.

FIG. 5B is a needle bar point diagram showing warp yarns 50 (in the 3+1 configuration), stitch yarns 10, and weft yarns 20. The resulting fabric 5 exhibits desirable properties in terms of tear strength, adhesion, dimensional stability, and smoothness, as compared with one or both of fabrics 3 and 4. It has been found that the inclusion of a round stitch (i.e., the "1" in the 3+1 configuration) results in the warp yarn 50 being attached to the stitch yarn 10 and weft yarn 20, causing the interstices between the yarns to be opened, as compared with fabric 3. Consequently, because the warp yarns 50 are closer to the stitch yarns 10, adhesion and dimensional stability are improved as compared to fabric 3. Moreover, because the warp yarns 50 are not "locked" into position (as in fabric 4), the yarns 50 are able to shift slightly as the fabric 5 is torn, resulting in increased tear strength values. Additionally, by having a majority of the length of the warp yarn 50 comprises a flat configuration, the surface smoothness of the fabric 5 is closer to that achievable with fabric 3.

Figure 5C:
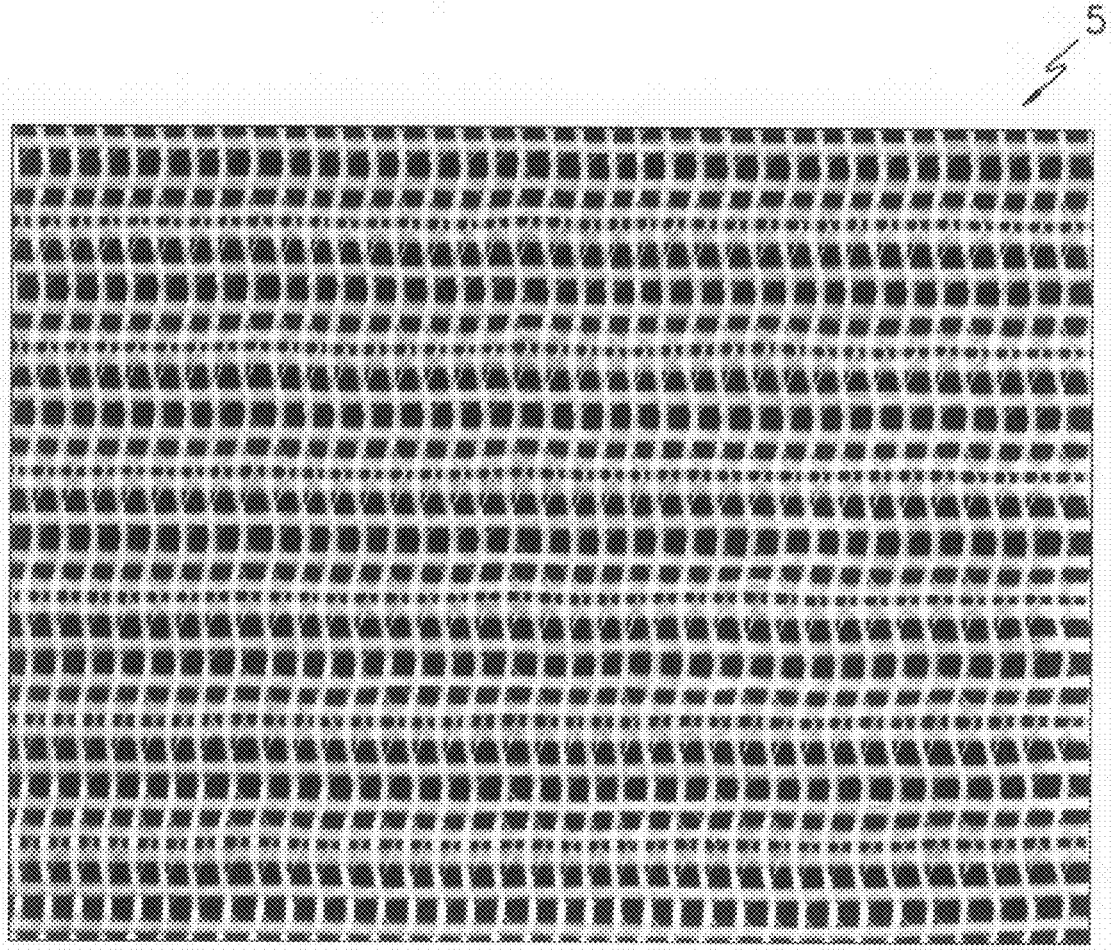
FIG. 5C is a photograph of the fabric of FIG. 5B, showing the non-uniform spacing between the warp and weft yarns.

FIG. 5C is a photograph of fabric 5, which shows the non-uniform spacing between the warp yarns and weft yarns, leading to non-uniformly sized and shaped interstices. A review of the photograph also reveals that the weft yarns, which are oriented horizontally, tend to group together in the area of the flat stitches. The proximity of these weft yarns to one another further contributes to the tear strength of the fabric 5.

Figure 6A:
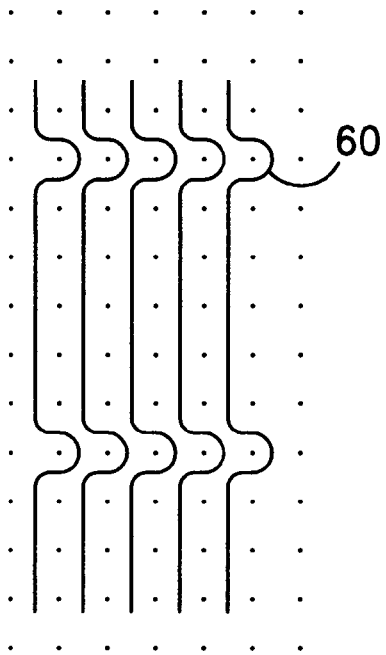
FIG. 6A is a needle bed point diagram of a 5+1 warp configuration, in which the warp yarns create a flat stitch pattern for five consecutive needle positions and a round stitch pattern for one needle position.
Figure 6B:
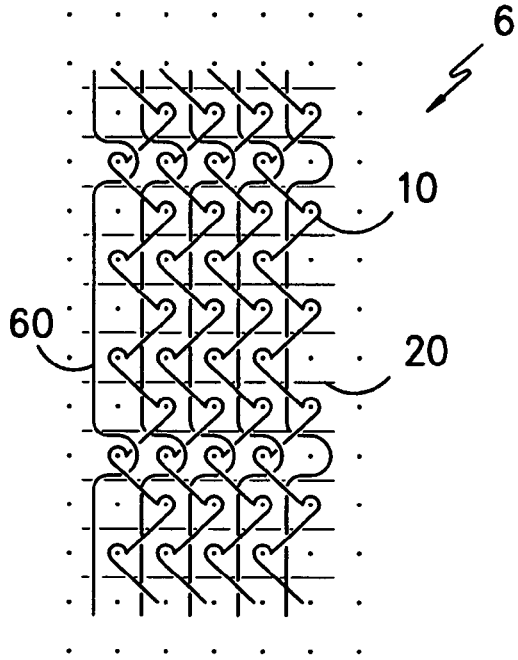
FIG. 6B is a needle bed point diagram of a weft-inserted warp knit fabric in which the warp yarns are present in the 5+1 configuration shown in FIG. 6A.

FIG. 6A is a needle bar point diagram showing a plurality of warp yarns 60 in a 5+1 warp yarn configuration. As shown, each warp yarn 50 produces five flat stitches before producing a single round stitch. This pattern is accomplished by allowing the guide bar to remain in a constant position for three courses and to then be shifted over one needle position to make a round stitch. After the round stitch is formed, the guide bar shifts back to its original position, and the pattern is repeated. FIG. 6B is a needle bar point diagram of fabric 6 showing warp yarns 60 (in the 5+1 configuration), stitch yarns 10, and weft yarns 20.

Figure 7A:
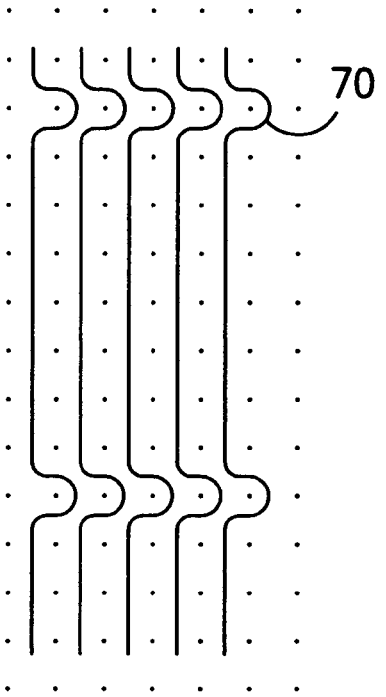
FIG. 7A is a needle bed point diagram of a 7+1 warp configuration, in which the warp yarns create a flat stitch pattern for seven consecutive needle positions and a round stitch pattern for one needle position.
Figure 7B:
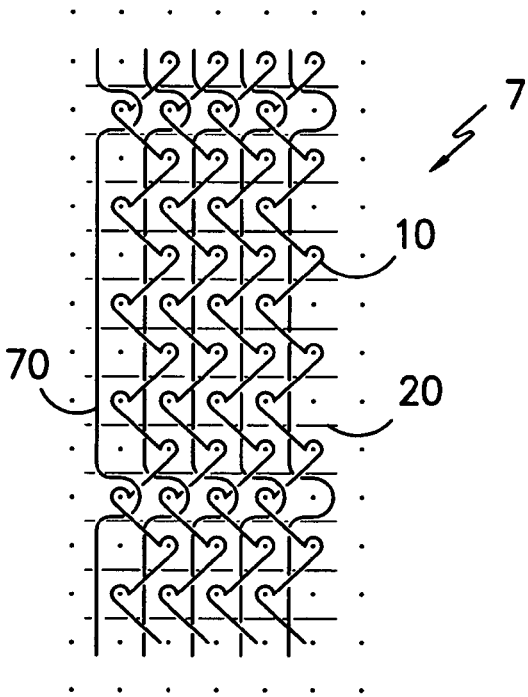
FIG. 7B is a needle bed point diagram of a weft-inserted warp knit fabric in which the warp yarns are present in the 7+1 configuration shown in FIG. 7A.

FIG. 7A is a needle bar point diagram showing a plurality of warp yarns 70 in a 7+1 warp yarn configuration. As can be seen, each warp yarn 70 creates seven flat stitches before being shifted over one needle position to create a round stitch. The round stitch connects the warp yarn to the stitch yarn, thereby creating a more dimensionally stable fabric. FIG. 7B is a needle bar point diagram of fabric 7 showing warp yarns 70 (in the 7+1 configuration), stitch yarns 10, and weft yarns 20.

Figure 8A:
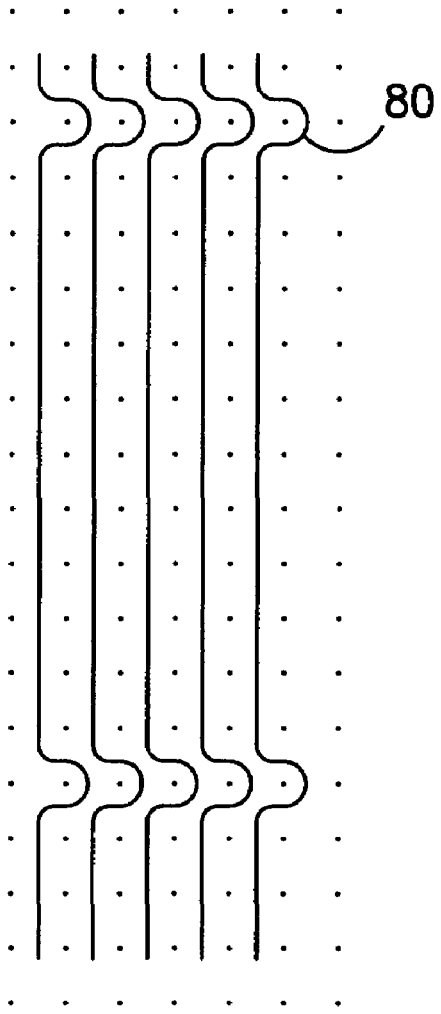
FIG. 8A is a needle bed point diagram of a 11+1 warp configuration, in which the warp yarns create a flat stitch pattern for eleven consecutive needle positions and a round stitch pattern for one needle position.
Figure 8B:
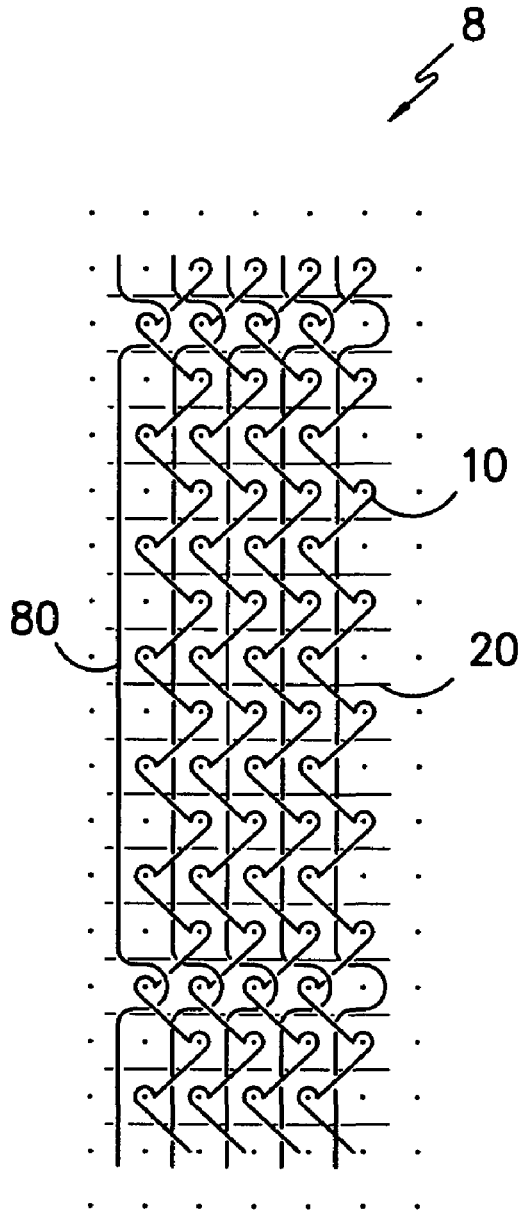
FIG. 8B is a needle bed point diagram of a weft-inserted warp knit fabric in which the warp yarns are present in the 11+1 configuration shown in FIG. 8A.

FIG. 8A is a needle bar point diagram showing a plurality of warp yarns 80 in a 11+1 warp yarn configuration. As can be seen, each warp yarn 80 creates eleven flat stitches before being shifted over one needle position to create a round stitch. The round stitch connects the warp yarn to the stitch yarn, thereby creating a more dimensionally stable fabric. FIG. 8B is a needle bar point diagram of fabric 8 showing warp yarns 80 (in the 11+1 configuration), stitch yarns 10, and weft yarns 20.

Figure 9A:
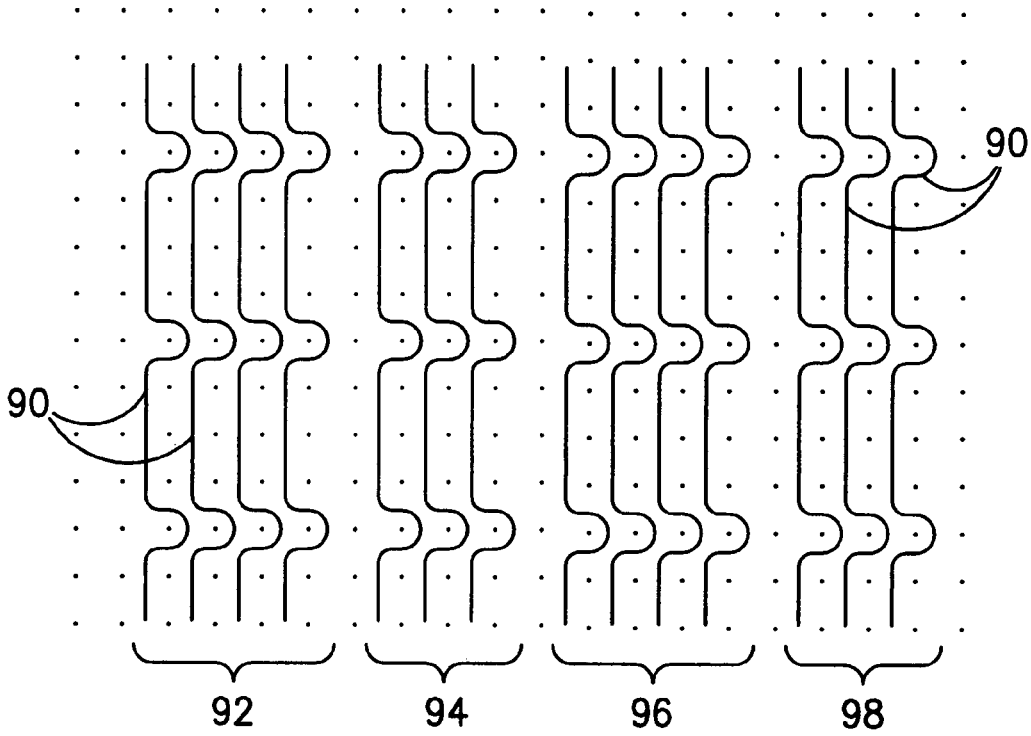
FIG. 9A is a needle bed point diagram of a 3+1 warp configuration, in which the warp yarns create a flat stitch pattern for three consecutive needle positions and a round stitch pattern for one needle position and in which the warp yarns are positioned in groups that are created by the removal of individual warp yarns at certain intervals.
Figure 9B:
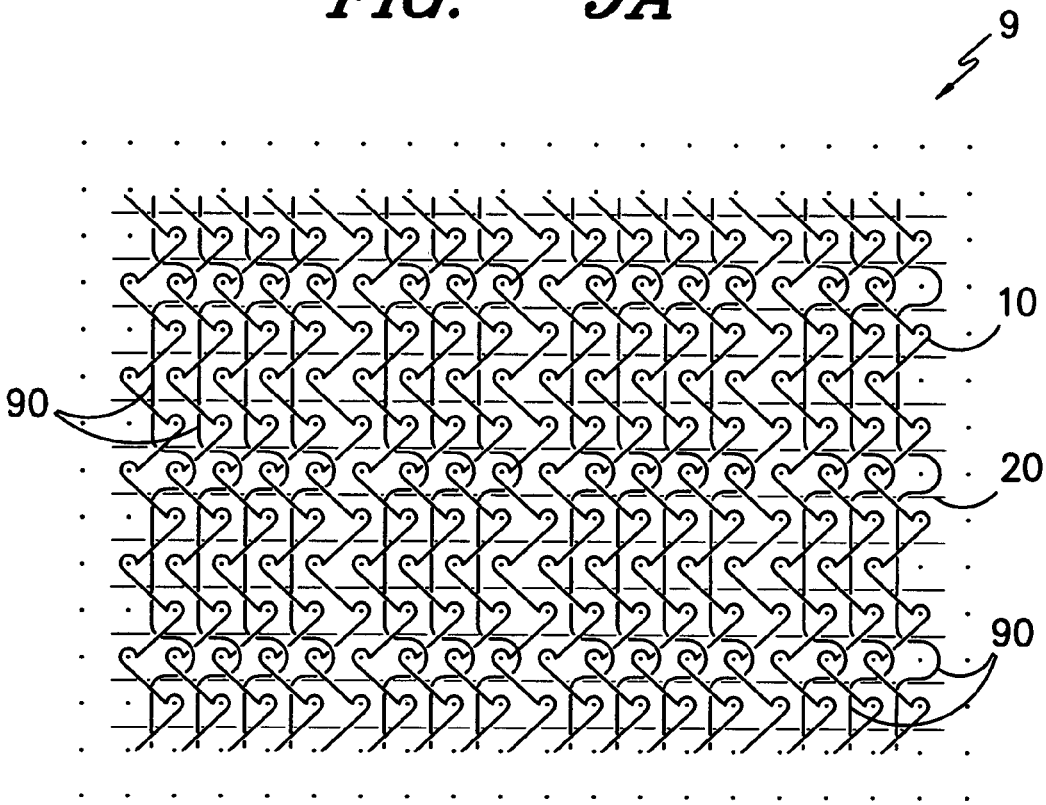
FIG. 9B is a needle bed point diagram of a weft-inserted warp knit fabric in which the warp yarns are present in the configuration shown in FIG. 9A.

FIG. 9A is a needle bar point diagram showing a plurality of warp yarns 90, which are arranged in warp yarn groups 92, 94, 96, and 98. The warp yarn groups 92, 94, 96, and 98 are spaced apart from one another by a distance equivalent to the spacing for a single warp yarn. As shown, groups 92, 96 each have three warp yarns, and groups 94, 98 each have four warp yarns. This pattern is provided for illustration only and is not intended to be limiting of the patterns that may be produced. Adjacent yarn groups may have the same number of yarns or may have different numbers of yarns. Preferably, in each instance, the spacing between the last yarn in a yarn group and the first yarn in the adjacent yarn group is equivalent to the spacing for a single warp yarn.

The x+y warp yarn configuration may be used across the width of the fabric. Alternately, the warp yarn configuration may be utilized only in a localized area of the fabric, such as the selvedges, with different configurations being used in the remainder of the fabric.

EXAMPLE 1

A weft-insert warp knit fabric was produced, which corresponds in warp yarn configuration to that shown in FIG. 4C (that is, a standard WIWK fabric having a round stitch configuration for the warp yarns). This fabric was produced on a 9-gauge machine, using 1000 denier continuous filament polyester warp yarns, 1000 denier continuous filament polyester weft yarns, and 70 denier polyester stitch yarns. There were 9 ends per inch in both the warp and weft directions.

The fabric was then coated on both sides with a thermoplastic olefin composition to provide a composite with a thickness of 45 mils.

EXAMPLE 2

A weft-insert warp knit fabric was produced, which corresponds in warp yarn configuration to that shown in FIG. 5C (that is, having a warp yarn configuration of 3+1). This fabric was produced on a 9-gauge machine, using 1000 denier continuous filament polyester warp yarns, 1000 denier continuous filament polyester weft yarns, and 70 denier polyester stitch yarns. There were 9 ends per inch in both the warp and weft directions.

The fabric was then coated on both sides with the same thermoplastic olefin composition used in Example 1 to provide a composite with a thickness of 45 mils.

EXAMPLE 3

A weft-insert warp knit fabric was produced, which corresponds in warp yarn configuration to that shown in FIG. 9C (that is, having a warp yarn configuration of 3+1, where the warp yarns are provided in alternating groups of three and four yarns). This fabric was produced on a 9-gauge machine, using only 7 ends per inch in the warp direction. This was achieved by threading four warp yarns in, one out, three in, and one out, etc.

The fabric was produced using 1000 denier continuous filament polyester warp yarns, 1000 denier continuous filament polyester weft yarns, and 70 denier polyester stitch yarns. There were 7 ends per inch in the warp direction and 9 ends per inch in the weft direction.

The fabric was then coated on both sides with the same thermoplastic olefin composition used in Example 1 to provide a composite with a thickness of 45 mils.

Composites made of each of the three example fabrics were then tested for their tear properties in the warp and weft directions. Photographs showing the composites, as torn perpendicularly to the weft yarns and therefore through the weft yarns (i.e., "in the weft direction"), are provided as FIGS. 10-12.

FIG. 10 is a photograph of the coated fabric of Example 1, after being subjected to tear strength testing in the weft direction according to ASTM D-751B. As may be observed, the tear in the composite is a clean tear with little distortion of the warp and weft yarns. The average tearing force was measured at 65 pounds.

FIG. 11 is a photograph of the coated fabric of Example 2, after being subjected to tear strength testing in the weft direction according to ASTM D-751B. As may be observed, the tear in the composite is a jagged tear, indicative of greater tearing force that was required. An area of distorted yarns is present on either side of the tear. The average tearing force was measured at 90 pounds.

Figure 12:
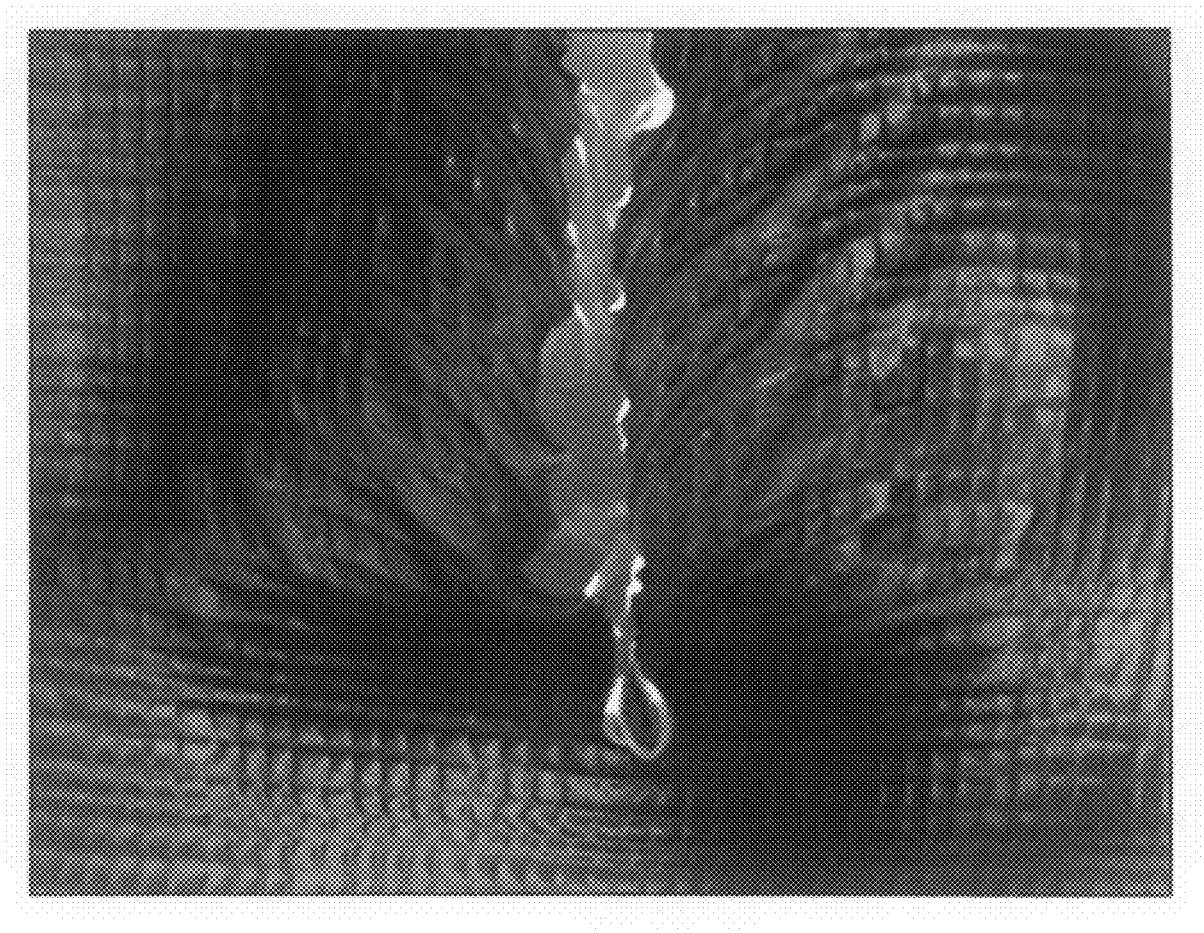
FIG. 12 is a photograph of a composite reinforced with the fabric of FIG. 9C, after such composite has been subjected to tear strength testing in the weft direction.

FIG. 12 is a photograph of the coated fabric of Example 3, after being subjected to tear strength testing in the weft direction according to ASTM D-751B. As may be observed, the tear in the composite is an extremely irregular tear, which indicates an even greater tearing force that was required. The area of distorted yarns is significantly larger than that of the composite shown in FIG. 11, and there appear to be air pockets between the yarns that correspond to the missing warp yarns. The average tearing force was measured at 130 pounds.

Thus, the fabrics produced in accordance with the teachings herein provided a composite with substantially improved tear properties. Additionally, it is believed that the present fabrics possess sufficient dimensional stability to withstand the coating process without geometric distortion within the body of the fabric.

It is anticipated that the present reinforcements described herein may have applications in a wide variety of products, including, without limitation, roofing membranes, signs, billboards, banners, tents and tent liners, and the like.

We claim:

1. A fabric reinforcement comprising a weft-insert, warp knit fabric, said weft-insert warp knit fabric having weft yarns, stitch yarns, and warp yarns, wherein each warp yarn has a warp yarn configuration that comprises at least one combination of successive flat stitches and at least one round stitch after said at least one combination of successive flat stitches, wherein the stitching yarns have a stitch yarn configuration of an open-loop stitch pattern, wherein the stitch yarns stitch around a warp yarn at each stitch of the stitching yarn, and wherein each stitching yarn stitches around two adjacent warp yarns in the fabric.

2. The fabric reinforcement of claim 1, wherein said warp yarn configuration has an x+y configuration, where x represents a number of successive flat stitches, where y represents a number of successive round stitches, and where x is in the range of 3 to 15 and y is in the range of 1 to 4.

3. The fabric reinforcement of claim 2, wherein said warp yarn configuration is a 3+1 configuration.

4. The fabric reinforcement of claim 2, wherein said warp yarn configuration is a 7+1 configuration.

5. The fabric reinforcement of claim 1, wherein said weft-insert warp knit fabric includes different warp yarn configurations areas across the width of said fabric.

6. The fabric reinforcement of claim 1, wherein said warp yarns are positioned in groups that are created by the removal of individual warp yarns at certain intervals.

7. The fabric reinforcement of claim 6, wherein said warp yarns are grouped in a pattern of four warp yarns and three warp yarns and wherein said interval between said groups of warp yarns is equivalent to the spacing for a single warp yarn.

8. A fabric-reinforced composite, said composite comprising:

(a) a weft-insert warp knit fabric, said weft-insert warp knit fabric having weft yarns, stitch yarns, and warp yarns, wherein each warp yarn has a warp yarn configuration that comprises at least one combination of successive flat stitches and at least one round stitch after said at least one combination of successive flat stitches, wherein the stitching yarns have a stitch yarn configuration of an open-loop stitch pattern, wherein the stitch yarns stitch around a warp yarn at each stitch of the stitching yarn, and wherein each stitching yarn stitches around two adjacent warp yarns in the fabric; and (b) a thermoplastic or elastomer coating composition applied to at least one side of said fabric.

9. The composite of claim 8, wherein said coating composition is applied to both sides of said fabric.

10. The composite of claim 8, wherein said wherein said warp yarn configuration has an x+y configuration, where x represents a number of successive flat stitches, where y represents a number of successive round stitches, and where x is in the range of 3 to 15 and y is in the range of 1 to 4.

11. The fabric reinforcement of claim 10, wherein said warp yarn configuration is a 3+1 configuration.

12. The fabric reinforcement of claim 10, wherein said warp yarn configuration is a 7+1 configuration.

13. The fabric reinforcement of claim 8, wherein said weft-insert warp knit fabric includes different warp yarn configurations areas across the width of said fabric.

14. The fabric reinforcement of claim 8, wherein said warp yarns are positioned in groups that are created by the removal of individual warp yarns at certain intervals.

15. The fabric reinforcement of claim 14, wherein said warp yarns are grouped in a pattern of four warp yarns and three warp yarns and wherein said interval between said groups of warp yarns is equivalent to the spacing for a single warp yarn.

16. The fabric reinforcement of claim 8, wherein the weft yarns are inserted into the fabric at each stitch of the stitching yarns.

17. The fabric reinforcement of claim 8, wherein the weft yarns are inserted into the fabric at each stitch of the stitching yarns.

18. A fabric reinforcement comprising a weft-insert, warp knit fabric, said weft-insert warp knit fabric having weft yarns, stitch yarns, and warp yarns, wherein each warp yarn has a warp yarn configuration that comprises at least one combination of successive flat stitches and at least one round stitch after said at least one combination of successive flat stitches, wherein the stitching yarns have a stitch yarn configuration of an open-loop stitch pattern and wherein each warp yarn comprises a stitch from a stitching yarn around the warp yarn each stitch of the stitching yarn open-loop stitch pattern.

19. The fabric reinforcement of claim 18, wherein said warp yarns are positioned in groups that are created by the removal of individual warp yarns at certain intervals.

20. The fabric reinforcement of claim 18, further comprising a thermoplastic or elastomer coating composition applied to at least one side of the fabric.

21. The fabric reinforcement of claim 18, wherein the weft yarns are inserted into the fabric at each stitch of the stitching yarns.

* * * * *